US009040859B2

(12) United States Patent
Yamada et al.

(10) Patent No.: US 9,040,859 B2
(45) Date of Patent: May 26, 2015

(54) DETECTING APPARATUS, REMOVING APPARATUS, DETECTING METHOD, AND REMOVING METHOD

(75) Inventors: Eiichiro Yamada, Yokohama (JP); Hiroshi Suganuma, Yokohama (JP); Yuji Kobayashi, Yokohama (JP); Tatsuhiko Saito, Yokohama (JP); Takayuki Shimazu, Yokohama (JP); Maya Miyata, Yokohama (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 1237 days.

(21) Appl. No.: 12/767,448

(22) Filed: Apr. 26, 2010

(65) Prior Publication Data

US 2010/0276344 A1 Nov. 4, 2010

(30) Foreign Application Priority Data

May 1, 2009 (JP) ..... 2009-112191

(51) Int. Cl.
*B07C 5/00* (2006.01)
*B07C 5/342* (2006.01)

(52) U.S. Cl.
CPC ..... *B07C 5/342* (2013.01)

(58) Field of Classification Search
CPC ..... B07C 5/342; B07C 5/3422; G01N 25/72
USPC ..... 209/576, 577, 585, 537, 591, 578–584, 209/586–590, 643; 348/125
See application file for complete search history.

(56) References Cited

U.S. PATENT DOCUMENTS 5,242,059 A 9/1993 Low et al.
6,054,665 A * 4/2000 Focke et al. ..... 209/576
(Continued)

FOREIGN PATENT DOCUMENTS

CN 101147906 A 3/2008
JP 63-163259 7/1988
(Continued)

OTHER PUBLICATIONS

Notification of Reasons for Rejection in Japanese Patent Application No. 2009-112191 dated Apr. 23, 2013.
(Continued)

*Primary Examiner* — Joseph C Rodriguez
*Assistant Examiner* — Kalyanavenkateshware Kumar
(74) *Attorney, Agent, or Firm* — Venable LLP; Michael A. Sartori; Tamatane J. Aga

(57) ABSTRACT

A detection apparatus for detecting foreign substances or defective goods, with which it is easy to accomplish inspection even if the inspection objects have a shape that tends to allow rolling, comprises: transparent members 11 and 12, partitions 21 and 22, a supplying unit 30, cameras 41 and 42, a control unit 50. A removing apparatus 1, which includes such detection apparatus, comprises a suction controller 60 and suction nozzles 61 to 68. While the partitions 21, 22 move around, inspection objects A are each put in each cell of the partitions 21, 22, and are photographed by the cameras 41 and 42, from above and below the transparent members 11, 12, respectively. The images obtained by such photographing are analyzed, and foreign substances or defective goods mingling in the inspection objects A are detected. The foreign substances or defective goods are separated from the conforming goods by selectively sucking the inspection objects A with the suction nozzles 61 to 64.

20 Claims, 6 Drawing Sheets

(56) References Cited

U.S. PATENT DOCUMENTS

| | | | | |
|---|---|---|---|---|
| 7,111,740 | B2 * | 9/2006 | Ogawa et al. | 209/539 |
| 7,262,380 | B1 * | 8/2007 | Ulrichsen et al. | 209/577 |
| 2006/0016735 | A1 * | 1/2006 | Ito et al. | 209/576 |

FOREIGN PATENT DOCUMENTS

| | | |
|---|---|---|
| JP | 10-35862 | 2/1998 |
| JP | 11-258183 | 9/1999 |
| JP | 2002-257743 | 9/2002 |
| JP | 2004-125597 | 4/2004 |
| JP | 2004-157027 | 6/2004 |
| JP | 2006-26469 | 2/2006 |
| JP | 2008-039645 | 2/2008 |
| WO | WO-2009/048904 A1 | 4/2009 |

OTHER PUBLICATIONS

Patent Examination Report issued in Australian Patent Application No. 2010201594 dated Feb. 6, 2014.

* cited by examiner

DETECTING APPARATUS, REMOVING APPARATUS, DETECTING METHOD, AND REMOVING METHOD

BACKGROUND OF THE INVENTION

1. Field of the Invention

The present invention relates to a detection apparatus for detecting foreign substances or defective goods, a removing apparatus for removing foreign substances or defective goods, a detection method for detecting foreign substances or defective goods, and a removing method for removing foreign substances or defective goods.

2. Description of the Background Arts

Known techniques for detecting foreign substances and defective goods which mingle in inspection objects (e.g., food or medicine) include an inspection using light, an inspection using a metal detector, an inspection using a magnetic sensor, and an inspection using X-rays. The techniques described in Japanese Patent Application Publication No. 2008-39645, JP2004-157027A, JPH10-35862A, JP2006-26469A, and JP2004-125597A are such that foreign substances or defective goods mingling in inspection objects are detected by analyzing the images obtained by photographing inspection objects, and the foreign substances or defective goods are separated from conforming goods according to the results of the detection.

According to the methods disclosed in these patent applications, however, it is not easy to achieve inspection by photographing inspection objects or to separate foreign substances or defective goods from conforming goods when the inspection objects have a shape which tends to roll. In the case where inspection objects tend to roll, it would occasionally occur that when foreign substances or defective goods are selectively to be removed, conforming goods are mistakenly taken out, or vise versa, or both of them are removed at the same time.

SUMMARY OF THE INVENTION

The object of the present invention is to provide a detection apparatus for detecting foreign substances or defective goods, a removing apparatus for removing the foreign substances or defective goods, a detection method for detecting foreign substances or defective goods, and a removing method for removing the foreign substances or defective goods, in all of which it is easy to accomplish inspection and separation even if the inspection objects have a shape that tends to allow rolling.

The detection apparatus of the present invention, with which foreign substances or defective goods mingling in inspection objects are detected according to images obtained by photographing the inspection objects, comprises: a transparent member, on which inspection objects are put; a partition for separating the inspection objects on the transparent member so that each piece of them may lie in a cell defined by the partition; a supplying unit for putting the inspection objects onto the partition so that one piece may lie in each cell; a camera unit for photographing inspection objects from above and below the transparent member; a control unit in which foreign substances or defective goods mingling in the inspection objects are detected by analyzing images photographed with the camera unit; and a transport means for moving the partition. The partition may be unified with the transparent member, or may be structured so as to move on the transparent member.

The removing apparatus, which is provided as another embodiment of the invention, comprises a detection apparatus of the present invention for detecting foreign substances or defective goods and a separation means for separating the foreign substances or defective goods from conforming goods. The separation of inspection objects contained in the cells of the partition is done by the selective suction operation of the separation means according to instructions given on the basis of detection results of the control unit.

Moreover, the invention provides a detection method for detecting foreign substances or defective goods mingling in inspection objects. The detection method comprises: supplying the inspection objects to a partition so that each piece of the inspection objects may lie in each cell of the partition while the partition on the transparent member is caused to make movement which is integral with or independent of the transparent member; photographing the inspection objects from above and below the transparent member; and detecting the foreign substances or defective goods, which exist mingling in the inspection objects, by analyzing images obtained by such photographing of the camera unit.

Moreover, the invention provides, as a further embodiment, a removing method for removing foreign substances or defective goods. The removing method comprises: detecting foreign substances or defective goods, which mingle in inspection objects, with the detection method of the invention; and separating the foreign substances or defective goods from conforming goods by selectively sucking the inspection objects.

DETAILED DESCRIPTION OF THE INVENTION

The above-mentioned features and other features, aspects, and advantages of the present invention will be better understood through the following description, appended claims, and accompanying drawings. In the explanation of the drawings, an identical mark is applied to identical elements and an overlapping explanation will be omitted. Hereinafter, in abbreviation, the detection apparatus for detecting foreign substances or defective goods is called the detection apparatus, and the removing apparatus for removing foreign substances or defective goods is called the removing apparatus.

Embodiment 1

Figure 1:
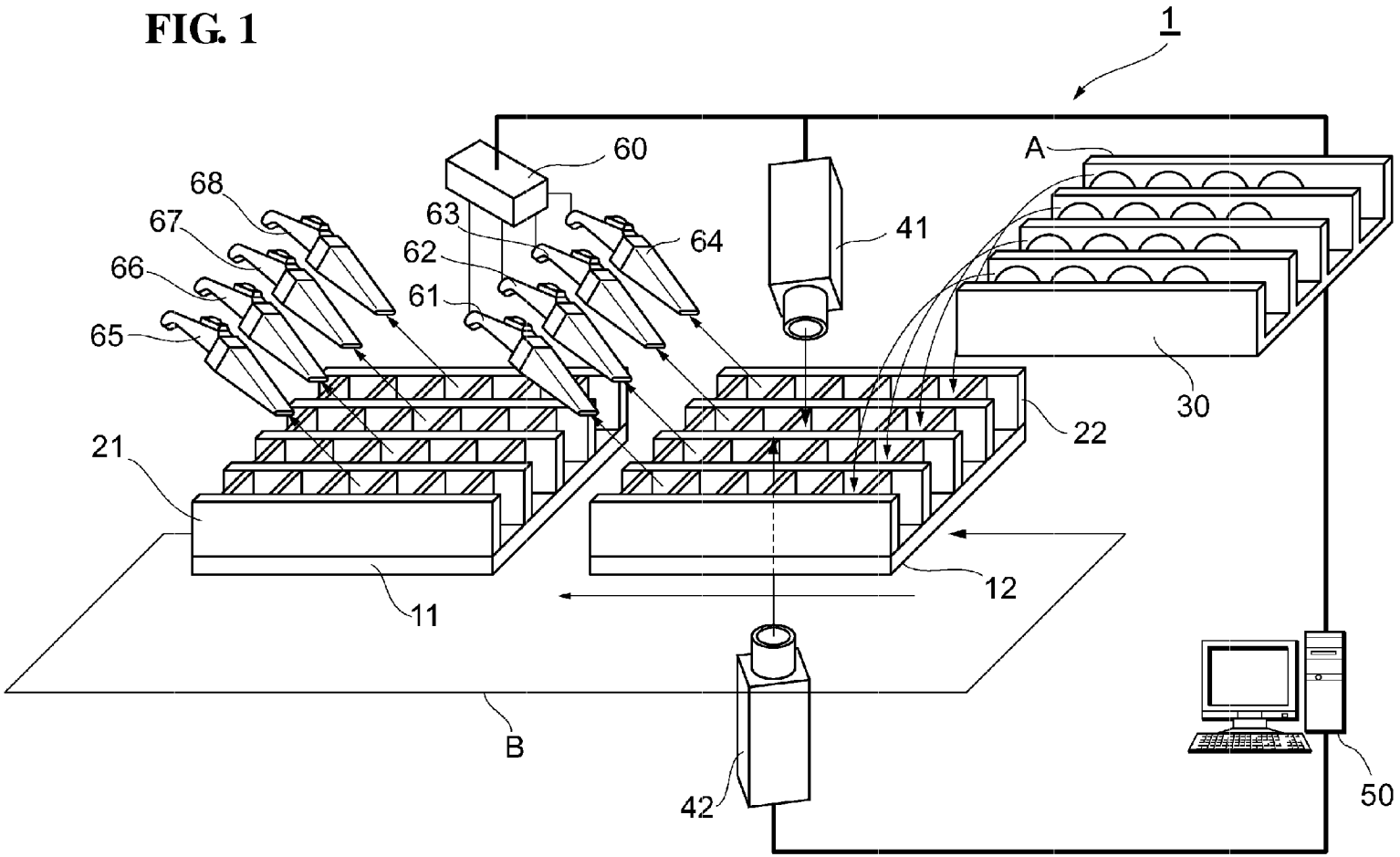
FIG. 1 is a conceptional schematic diagram showing a detection apparatus for detecting foreign substances or defective goods and a removing apparatus for removing the foreign substances or defective goods, according to Embodiment 1 of the present invention.

FIG. 1 is a conceptional schematic diagram showing the detection apparatus and the removing apparatus 1 relating to Embodiment 1 of the present invention. The detection apparatus included in the removing apparatus 1 detects, on the basis of images obtained by photographing inspection objects A, foreign substances or defective goods mingling in the inspection objects A, and on the basis of the results of such detection, the removing apparatus 1 separates the inspection objects A in terms of conforming goods and foreign substances or defective goods. The detection apparatus relating to Embodiment 1 comprises transparent members 11 and 12, partitions 21 and 22, a supplying unit 30, cameras 41 and 42, and a control unit 50. The removing apparatus 1 comprises a suction controller 60 and suction nozzles 61 to 68, in addition to the detection apparatus.

The transparent members 11 and 12 have a board-like shape and are made of a material that is transparent to a wavelength to which the cameras 41 and 42 are sensitive. The partition 21 functions to separate the inspection objects A on the transparent member 11 so that each piece of the inspection objects A may lie in each cell of the partition 21. The partition 22 functions to separate the inspection objects A on the transparent member 12 so that each piece of the inspection objects A may lie in each cell of the partition 22. The partition 21 and the transparent member 11 are unified. The partition 22 and the transparent member 12 are unified. It is preferable that spaces be provided between the transparent members 11, 12 and the partitions 21, 22. The spaces function as inlets for air at the time of suction operation, so that the suction power improves.

The transparent member 11 and the partition 21 which are united together, as well as the transparent member 12 and the partition 22 which are united together, move around along arrow B as shown in FIG. 1. That is, the detection apparatus relating to Embodiment 1 is equipped with a transport means for moving the partitions 21, 22. A plurality of cells in the partitions 21, 22 are arranged two-dimensionally in the direction of the partition movement and in the direction orthogonal thereto. (Three or more sets of transparent members and partitions may be provided, and in that case, also the partitions move along the arrow B as in Embodiment 1.)

The supplying unit 30 has the same number of grooves as the number of cell lines (the number of cells arranged in the direction orthogonal to the moving direction) in the partitions 21, 22. The supplying unit 30 feeds each piece of inspection objects A to each cell of the partitions 21, 22 by moving the inspection objects A along the grooves until the inspection objects A drop from its one end into the respective cells.

The cameras 41 and 42 constitute a camera unit for photographing the inspection objects A from above and below the transparent members 11, 12. The camera 41 is provided above the transparent members 11, 12, and the camera 42 is provided below the transparent members 11, 12.

The cameras 41, 42 preferably are sensitive to at least a part of the wavelength range of 1000 nm to 2500 nm and it is possible to improve the precision in judging foreign substances and defective goods by photographing the inspection objects A at a wavelength of the near-infrared region. Moreover, the cameras 41, 42 preferably include a spectroscope and a two-dimensional photodetector such as CCV (charge-coupled device), and the position of a first direction (the direction orthogonal to the direction of movement) in the light-receiving face of the CCV corresponds to the position of an object to be photographed, while the position of a second direction (the direction of movement) corresponds to the wavelength of light split by the spectroscope. By doing so, it is made possible to obtain the images of moving inspection objects A at a spectrum within a given wavelength range.

The control unit 50 analyzes images obtained by photographing with the cameras 41, 42, and thereby detects foreign substances or defective goods mingling in the inspection objects A. Moreover, based on the results of such detection, the control unit 50 gives instructions to the suction controller 60 so that it may separate the foreign substances or defective goods from conforming goods by selectively sucking the inspection objects A put in the cells of the partitions 21, 22.

The suction controller 60 controls the suction operation of the suction nozzles 61 to 68 according to the instructions given by the control unit 50. The suction nozzles 61 to 64 remove the foreign substances or defective goods by sucking them up out of the inspection objects A which are each put in each cell of the partition 22. The suction nozzles 65 to 68 collect the conforming goods by sucking them up out of the inspection objects A which are each put in a cell of the partition 21. That is, the suction controller 60 and the suction nozzles 61 to 68 constitute a separation means for achieving separation between conforming goods and foreign substances or defective goods.

In Embodiment 1, the partition 21 that is united with the transparent member 11 and the partition 22 that is united with the transparent member 12 move around. During the process of such movement, the inspection objects A are each fed by the supplying unit 30 to each cell of the partitions 21, 22. Under the conditions where each of the inspection objects A lie in a cell of the partitions 21, 22, the inspection objects A are photographed by the cameras 41 and 42, from above and below the transparent members 11, 12, respectively.

The images obtained by such photographing are analyzed by the control unit 50, and thereby foreign substances or defective goods mingling in the inspection objects A are detected. Moreover, based on the results of such detection, instructions are given to the suction controller 60 by the control unit 50. Then, according to the instructions from the control unit 50, the suction nozzles 61 to 64 suck foreign substances or defective goods out of the inspection objects A each of which is put in each cell of the partition 22, and thereby the foreign substances or defective goods are removed. Also, by the suction operation of the suction nozzles 65 to 68, the conforming goods are collected from the inspection objects A each of which is put in each cell of the partition 21.

Thus, under the conditions where the inspection objects A are each put in each cell of the partitions 21 and 22, the inspection objects A are photographed, and the suction removal of the foreign substances or defective goods, as well as the suction collection of the conforming goods, is performed, whereby the inspection and selection of the inspection objects A are done easily even if the inspection objects A have a shape that tends to allow rolling.

Embodiment 2

Figure 2:
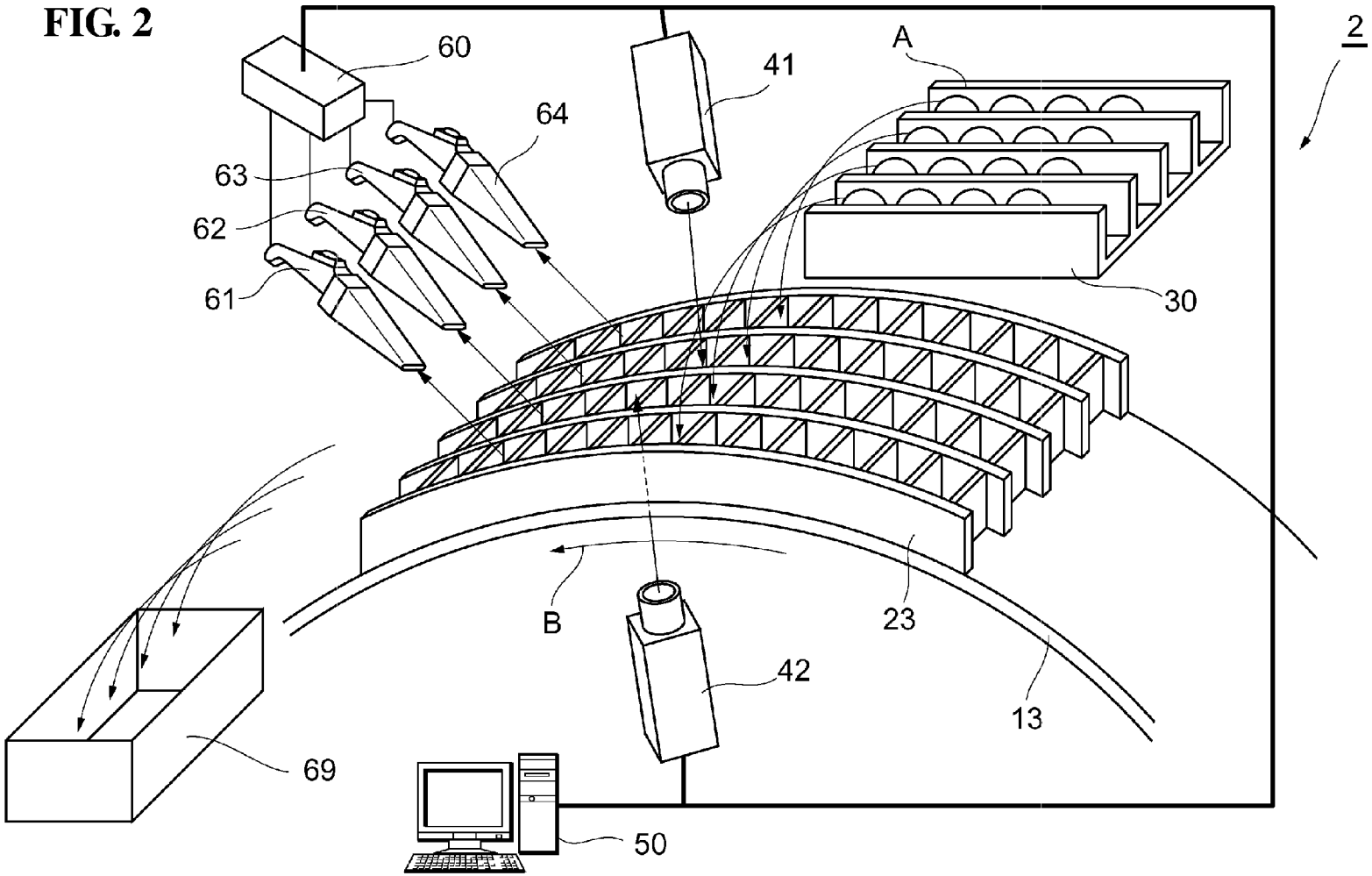
FIG. 2 is a conceptional schematic diagram showing a detection apparatus for detecting foreign substances or defective goods and a removing apparatus for removing the foreign substances or defective goods, according to Embodiment 2 of the present invention.

FIG. 2 is a conceptional schematic diagram showing a detection apparatus for detecting foreign substances or defective goods and a removing apparatus for removing the foreign substances or defective goods, according to Embodiment 2 of the present invention. The detection apparatus included in the removing apparatus 2 detects, on the basis of images obtained by photographing inspection objects A, foreign substances or defective goods mingling in inspection objects A, and on the basis of the results of such detection, the removing apparatus 2 separates the inspection objects A in terms of conforming goods and foreign substances or defective goods. The detection apparatus relating to Embodiment 2 comprises a transparent member 13, a partition 23, a supplying unit 30, cameras 41 and 42, and a control unit 50. The removing apparatus 2 comprises, in addition to the detection apparatus, a suction controller 60, suction nozzles 61 to 64, and a collection box 69 for collecting conforming goods.

The transparent member 13 has a cylindrical form, and consists of a material transparent to a wavelength to which the cameras 41, 42 are sensitive. The partition 23 function to separate the inspection objects A on the transparent member 13 so that each piece of the inspection objects A may lie in each cell of the partition 23. The transparent member 13 is united with the partition 23. (The partition 23 is provided around the whole circumference of the cylindrical transparent member 13; however, FIG. 2 shows only a part thereof.) Preferably, spaces are provided between the transparent member 13 and the partition 23.

The transparent member 13 and the partition 23 which are united together turn along arrow B as shown in FIG. 2. That is, the detection apparatus relating to Embodiment 2 is equipped with a transport means for moving the partition 23. A plurality of cells in the partition 23 are arranged two-dimensionally in the direction of movement of the partition and in the direction orthogonal thereto.

The supplying unit 30 has the same number of grooves as the number of cell lines (the number of cells arranged in the direction orthogonal to the direction of movement) in the partition 23. The supplying unit 30 feeds each piece of inspection objects A to each cell of the partition 23 by moving them along the grooves until they drop from its one end into the respective cells.

The cameras 41 and 42 constitute a camera unit for photographing the inspection objects A from above and below the transparent member 13. The camera 41 is placed outside the cylindrical transparent member 13, and the camera 42 is placed inside the cylindrical transparent member 13.

The control unit 50 analyzes images obtained by photographing with the cameras 41, 42, and thereby detects foreign substances or defective goods mingling in the inspection objects A. Moreover, based on the results of such detection, the control unit 50 gives instructions to the suction controller 60 so that it may separate the foreign substances or defective goods from conforming goods by selectively sucking the inspection objects A put in the cells of the partition 23.

The suction controller 60 controls the suction operation of the suction nozzles 61 to 64 according to the instruction given by the control unit 50. The suction nozzles 61 to 64 remove the foreign substances or defective goods by sucking them up out of the inspection objects A put in the cells of the partition 23. The collection box 69 for conforming goods collects the conforming goods which have dropped as the transparent member 13 turns (which results in up-and-down reverse transfer). That is, the suction controller 60, the suction nozzles 61 to 64, and the collection box 69 constitute a separation means for achieving separation between conforming goods and foreign substances or defective goods. (The conforming goods of the inspection object A may be recovered by sucking operation, and the foreign substances or defective goods which have dropped may be removed.)

In Embodiment 2, the cylindrical transparent member 13 that is united with the partition 23 performs rotational transfer. During the process of the rotational transfer, each of the inspection objects A is fed by the supplying unit 30 to each cell of the partition 23. Under the conditions where the inspection objects A are each put in each cell of the partition 23, the inspection objects A are photographed by the cameras 41 and 42 from above and below of the transparent member 13.

The images obtained by such photographing are analyzed by the control unit 50, and thereby foreign substances or defective goods mingling in the inspection objects A are detected. Moreover, based on the results of such detection, the control unit 50 gives instructions to the suction controller 60. Then, according to the instructions from the control unit 50, the suction nozzles 61 to 64 suck foreign substances or defective goods out of the inspection objects A each of which is put in each cell of the partition 23, and thereby the foreign substances or defective goods are removed. Also, as the transparent member 13 turns, the conforming goods of the inspection objects A, which are each put in each cell of the partition 23, drop to be recovered by the collection box 69 for conforming goods.

As described above, in Embodiment 2, the inspection objects A are photographed under the conditions where the inspection objects A are each put in each cell of the partition 23, and then the removal of the foreign substances or defective goods, as well as the recovery of the conforming goods, is performed, whereby the inspection and selection of the inspection objects A are made easily even if the inspection objects A have a shape that tends to allow rolling.

Embodiment 3

Figure 3:
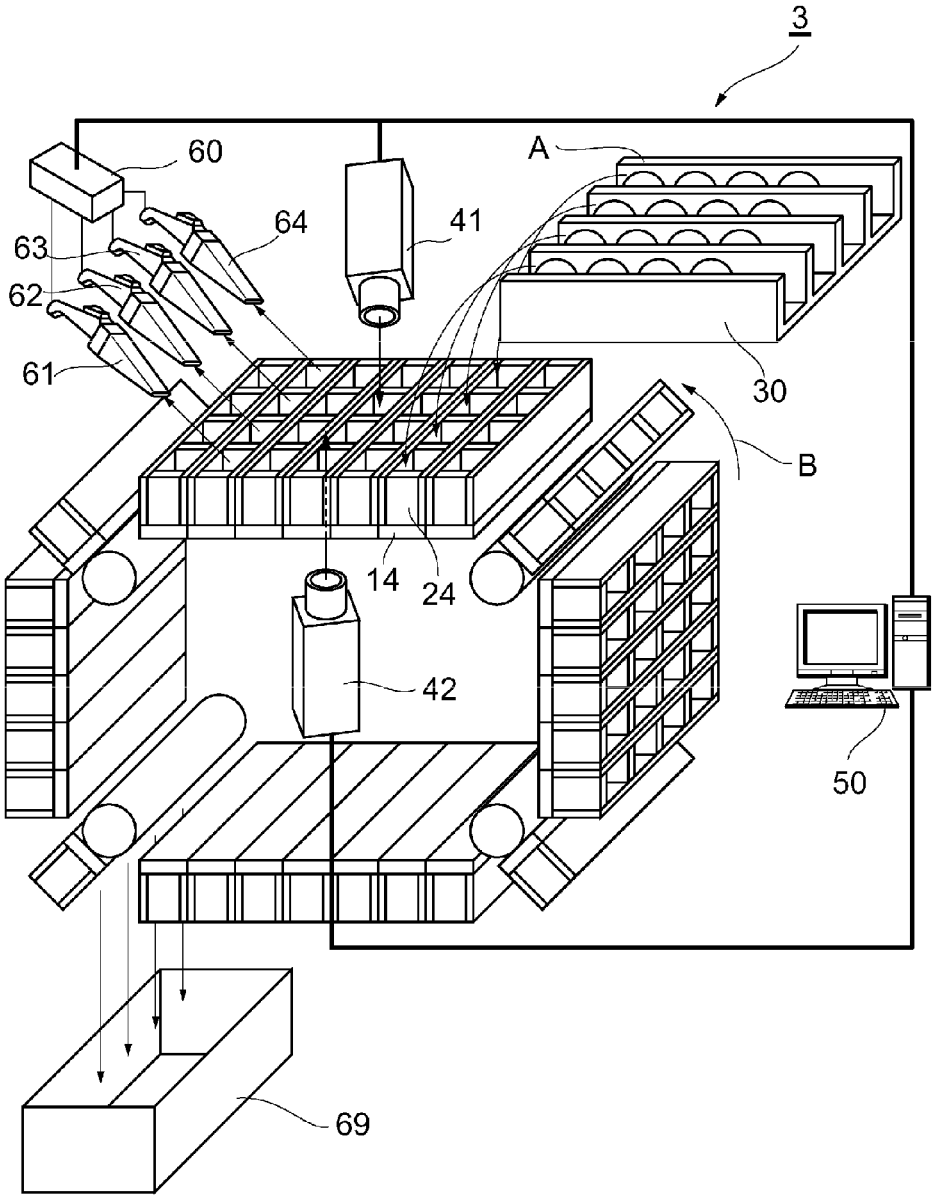
FIG. 3 is a conceptional schematic diagram showing a detection apparatus for detecting foreign substances or defective goods and a removing apparatus for removing the foreign substances or defective goods, according to Embodiment 3 of the present invention.

FIG. 3 is a conceptional schematic diagram showing the detection apparatus and the removing apparatus according to Embodiment 3 of the present invention. The detection apparatus included in the removing apparatus 3 detects, on the basis of images obtained by photographing inspection objects A, foreign substances or defective goods mingling in inspection objects A, and on the basis of the results of such detection, the removing apparatus 3 separates the inspection objects A in terms of conforming goods and foreign substances or defective goods. The detection apparatus relating to Embodiment 3 comprises plural transparent members 14, plural columns of partitions 24, a supplying unit 30, cameras 41 and 42, and a control unit 50. The removing apparatus 3 comprises, in addition to the detection apparatus, a suction controller 60, suction nozzles 61 to 64, and a collection box 69 for collecting conforming goods.

The transparent member 14 has a board-like shape and is made of a material that is transparent to a wavelength to which the cameras 41 and 42 are sensitive. The partition 24 functions to separate inspection objects A on the transparent member 14 so that each piece of the inspection objects A may lie in each cell thereof. Each of the partitions 24 is united with one of the transparent members 14 in a column-by-column manner. Preferably, adjacent columns are mutually connected in a caterpillar-like manner, the means of which is not illustrated. It is preferable that spaces are provided between the transparent member 14 and the partition 24.

The transparent members 14 and the partitions 24 turn column by column along arrow B as shown in FIG. 3. That is, the detection apparatus relating to Embodiment 3 is equipped with a transport means for moving the partitions 24. A plurality of cells in each column of the partitions 24 are arranged in a direction that is orthogonal to the direction of movement.

The supplying unit 30 has the same number of grooves as the number of cell lines (the number of cells arranged in the direction orthogonal to the direction of movement) in the partitions 24. The supplying unit 30 feeds each piece of inspection objects A to each cell of the partitions 24 by moving the inspection objects A along the grooves until they drop from its one end into the respective cells.

The cameras 41 and 42 constitute a camera unit for photographing the inspection objects A from above and below the transparent members 14. The camera 41 is provided above the transparent members 14, and the camera 42 is provided below the transparent members 14.

The control unit 50 analyzes images obtained by photographing with the cameras 41, 42, and thereby detects foreign substances or defective goods mingling in the inspection objects A. Moreover, based on the results of such detection, the control unit 50 gives instructions to the suction controller 60 so that it may separate the foreign substances or defective goods from conforming goods by selectively sucking the inspection objects A put in the cells of the partitions 24.

The suction controller 60 controls the suction operation of the suction nozzles 61 to 64 according to the instructions given by the control unit 50. The suction nozzles 61 to 64 remove the foreign substances or defective goods by sucking them up out of the inspection objects A put in the cells of the partitions 24. The collection box 69 for conforming goods recovers the conforming goods which have dropped as the transparent members 14 turn. That is, the suction controller 60, the suction nozzles 61 to 64, and the collection box 69 constitute a separation means for achieving separation between conforming goods and foreign substances or defective goods.

In Embodiment 3, the board-shaped transparent members 14 which are united with the partitions 24 column by column perform rotational transfer. During the process of such rotational movement, the inspection objects A are each fed by the supplying unit 30 to each cell of the partitions 24. Under the conditions where the inspection objects A are each put in each cell of the partitions 24, the inspection objects A are photographed by the cameras 41 and 42 from above and below the transparent members 14.

The images obtained by such photographing are analyzed by the control unit 50, and thereby foreign substances or defective goods mingling in the inspection objects A are detected. Moreover, based on the results of such detection, the control unit 50 gives instructions to the suction controller 60. Then, according to the instructions from the control unit 50, the suction nozzles 61 to 64 suck foreign substances or defective goods out of the inspection objects A each of which is put in each cell of the partitions 24, and thereby the foreign substances or defective goods are removed. Also, as the transparent members 14 turn, the conforming goods of the inspection objects A, each of which is put in each cell of partitions 24, drop to be recovered by the collection box 69 for conforming goods.

As described above, in Embodiment 3, the inspection objects A are photographed under the conditions where the inspection objects A are each put in each cell of the partitions 24, and then the suction removal of the foreign substances or defective goods, as well as the recovery of the conforming goods, is performed, whereby the inspection and selection of the inspection objects A are done easily even if the inspection objects A have a shape that tends to allow rolling.

Embodiment 4

Figure 4:
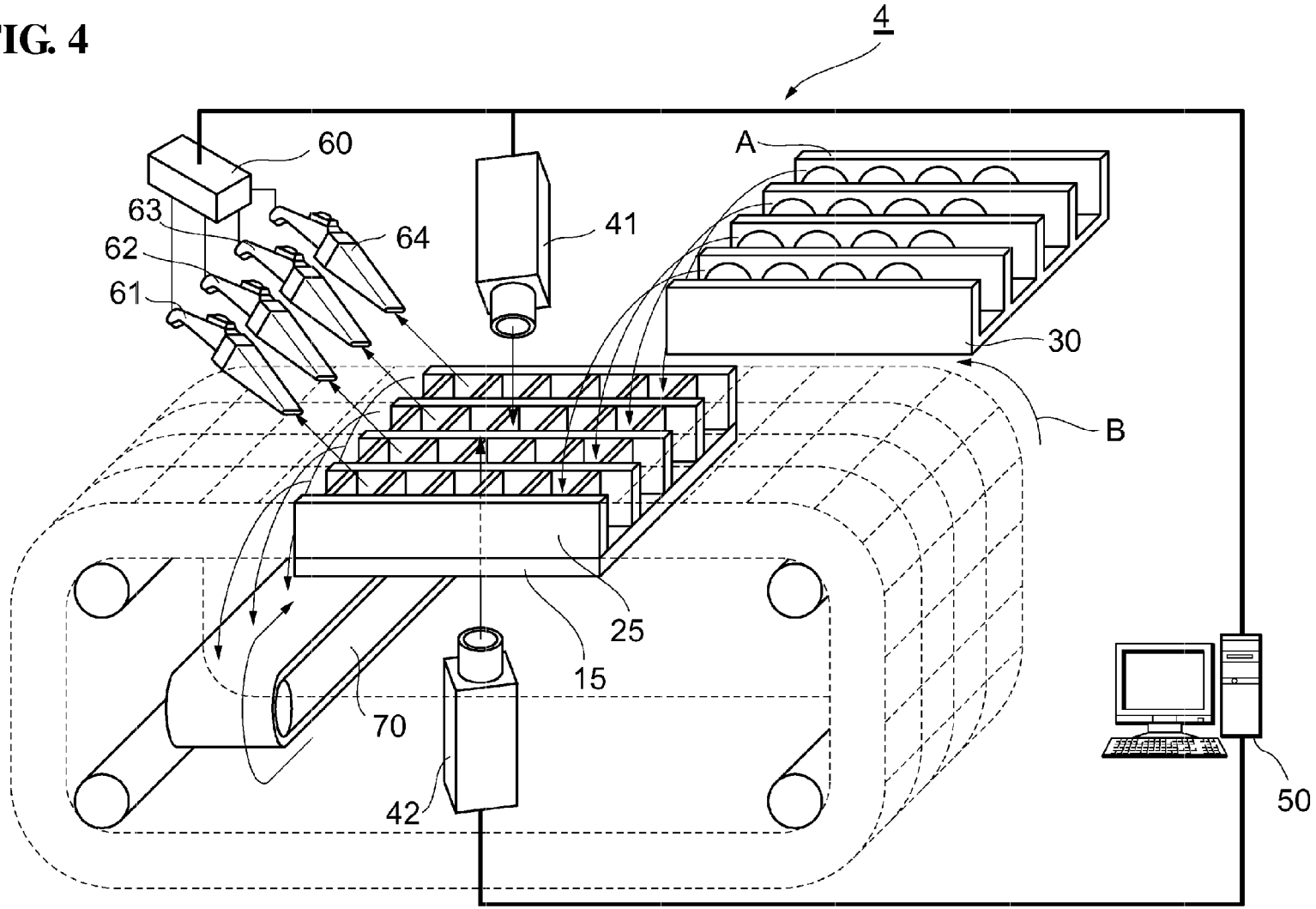
FIG. 4 is a conceptional schematic diagram showing a detection apparatus for detecting foreign substances or defective goods and a removing apparatus for removing the foreign substances or defective goods, according to Embodiment 4 of the present invention.

FIG. 4 is a conceptional schematic diagram showing the detection apparatus and the removing apparatus according to Embodiment 4 of the present invention. The detection apparatus included in the removing apparatus 4 detects, on the basis of images obtained by photographing inspection objects A, foreign substances or defective goods mingling in inspection objects A, and on the basis of the results of such detection, the removing apparatus 4 separates the inspection objects A in terms of conforming goods and foreign substances or defective goods. The detection apparatus relating to Embodiment 4 comprises a transparent member 15, a partition 25, a supplying unit 30, cameras 41 and 42, and a control unit 50. The removing apparatus 4 comprises, in addition to the detection apparatus, a suction controller 60, suction nozzles 61 to 64, and a conveyor belt 70 for collecting conforming goods.

The transparent member 15, which is fixed at a position, has a board-like shape and is made of a material that is transparent to a wavelength to which the cameras 41 and 42 are sensitive. The partition 25 separates the inspection objects A on the transparent member 15 so that each piece of the inspection objects A may lie in each cell thereof. The transparent member 15 and the partition 25 are not united together. The partition 25 has a conveyor belt-like structure and moves on the transparent member 15. Preferably, spaces are provided between the partition 25 and the transparent member 15.

The partition 25 turns as indicated by arrow B in FIG. 4. That is, the detection apparatus relating to Embodiment 4 is equipped with a transport means for moving the partition 25. A plurality of cells in the partition 25 are arranged two-dimensionally in the direction of movement and in the direction orthogonal to the direction of movement.

The supplying unit 30 has the same number of grooves as the number of cell lines (the number of cells arranged in the direction orthogonal to the direction of the movement) in the partition 25. The supplying unit 30 feeds each piece of inspection objects A to each cell of the partition 25 on the transparent member 15 by moving the inspection objects A along the grooves until they drop from its one end into the respective cells.

The cameras 41 and 42 constitute a camera unit for photographing the inspection objects A from above and below the transparent member 15. The camera 41 is provided above the transparent member 15, and the camera 42 is provided below the transparent member 15.

The control unit 50 analyzes images obtained by photographing with the cameras 41, 42, and thereby detects foreign substances or defective goods mingling in the inspection objects A. Moreover, based on the results of such detection, the control unit 50 gives instructions to the suction controller 60 so that it may separate the foreign substances or defective goods from conforming goods by selectively sucking the inspection objects A put in the cells of the partition 25.

The suction controller 60 controls the suction operation of the suction nozzles 61 to 64 according to the instructions given by the control unit 50. The suction nozzles 61 to 64 remove the foreign substances or defective goods by suction operation out of the inspection objects A which each lie in each cell of the partition 25 on the transparent member 15. The conveyor belt 70 for collecting conforming goods recovers the conforming goods that have fallen as the partition 25 moves. That is, the suction controller 60, the suction nozzles 61 to 64, and the conveyor belt 70 constitute a separation means for achieving separation between conforming goods and foreign substances or defective goods.

In Embodiment 4, the partition 25 having a shape like a belt conveyor performs rotational transfer on the fixed board-shaped transparent member 15. During the process of such rotational movement, each of the inspection objects A is fed by the supplying unit 30 to each cell of the partition 25 on the transparent member 15. Under the conditions where the inspection objects A are each put in each cell of the partition 25, the inspection objects A are photographed by the cameras 41 and 42 from above and below the transparent member 15, respectively.

The control unit 50 analyzes images obtained by such photographing, and thereby detects foreign substances or defective goods mingling in the inspection objects A. Moreover, based on the results of such detection, the control unit 50 gives instructions to the suction controller 60. Then, out of the inspection objects A which are each put in each cell of the partition 25 on the transparent member 15, the foreign substances or defective goods are selectively sucked up by the suction nozzles 61 to 64 according to the instructions from the control unit 50, and thereby the foreign substances or defective goods are removed. Also, as the partition 25 moves, the conforming goods of the inspection objects A which are each put in each cell of the partition 25 fall to be recovered by the conveyor belt 70 for collecting conforming goods.

As described above, in Embodiment 4, the inspection objects A are photographed under the conditions where the inspection objects A are each put in each cell of the partition 25, and then the suction removal of the foreign substances or defective goods, as well as the suction collection of the conforming goods, is performed, whereby the inspection and selection of the inspection objects A are done easily even if the inspection objects A have a shape that tends to allow rolling.

Embodiment 5

Figure 5:
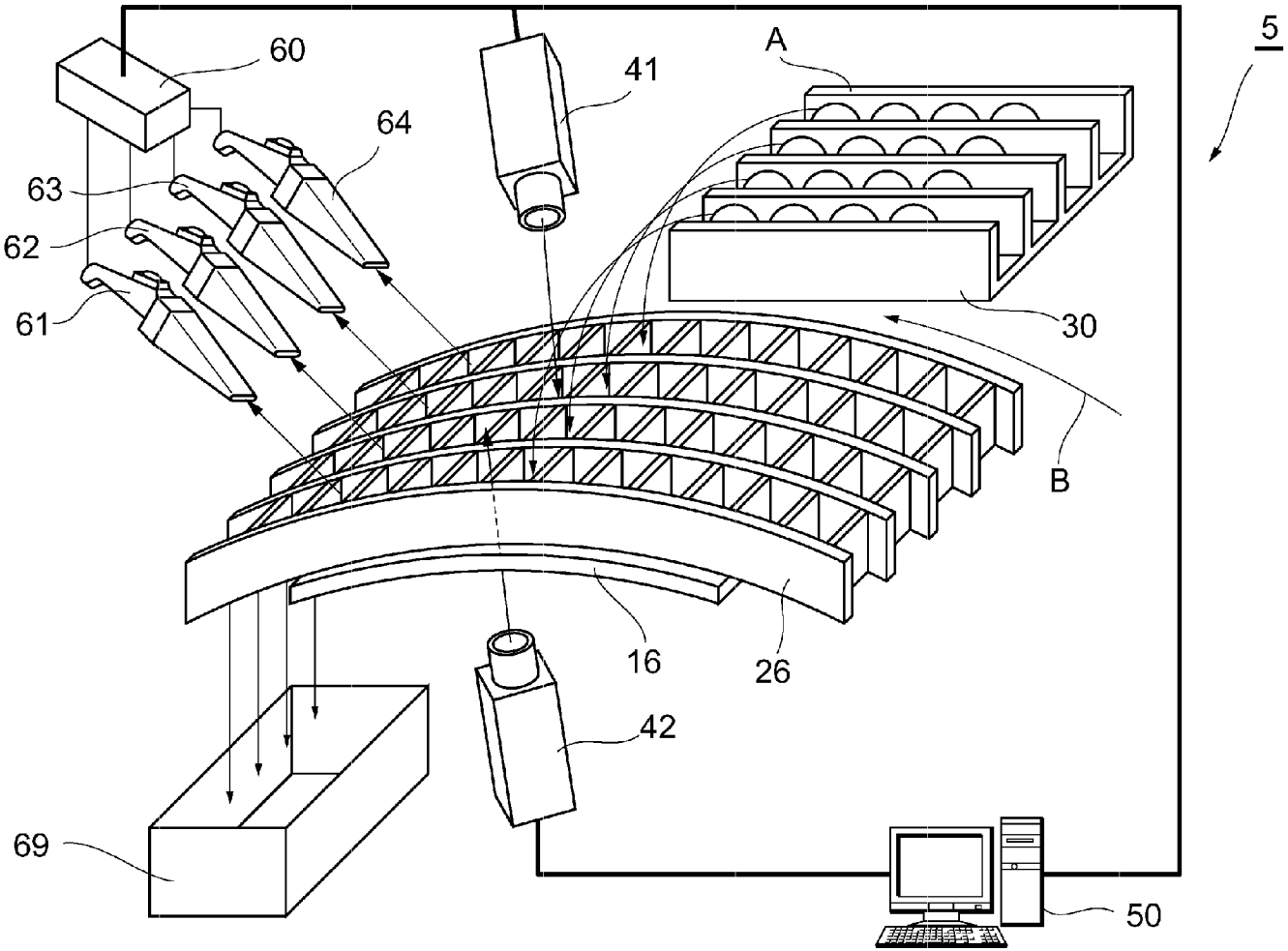
FIG. 5 is a conceptional schematic diagram showing a detection apparatus for detecting foreign substances or defective goods and a removing apparatus for removing the foreign substances or defective goods, according to Embodiment 5 of the present invention.

FIG. 5 is a conceptional schematic diagram showing the detection apparatus and the removing apparatus according to Embodiment 5 of the present invention. The detection apparatus included in the removing apparatus 5 detects, on the basis of images obtained by photographing inspection objects A, foreign substances or defective goods mingling in inspection objects A, and on the basis of the results of such detection, the removing apparatus 5 separates the inspection objects A in terms of conforming goods and foreign substances or defective goods. The detection apparatus relating to Embodiment 5 comprises a transparent member 16, a partition 26, a supplying unit 30, cameras 41 and 42, and a control unit 50. The removing apparatus 5 comprises, in addition to the detection apparatus, a suction controller 60, suction nozzles 61 to 64, and a collection box 69 for conforming goods.

The transparent member 16, whose position is fixed, has a board-like shape having an arc side-cross-section, and is made of a material transparent to a wavelength to which the cameras 41 and 42 are sensitive. The partition 26 functions to separate the inspection objects A on the transparent member 16 so that each piece of the inspection objects A may lie in each cell thereof. The transparent member 16 is not united with the partition 26. The partition 26 has a hollow cylindrical form so as to move on the transparent member 16. (In FIG. 5, only a part of the partition 26 is shown.) Preferably, spaces are provided between the partition 26 and the transparent member 16.

The partition 26 turns as shown by arrow B in FIG. 5. That is, the detection apparatus relating to Embodiment 5 is equipped with a transport means for moving the partition 26. A plurality of cells in the partition 26 are arranged two-dimensionally in the direction of the partition movement and in the direction orthogonal thereto.

The supplying unit 30 has the same number of grooves as the number of cell lines (the number of cells arranged in the direction orthogonal to the direction of the movement) in the partition 26. The supplying unit 30 feeds each piece of inspection objects A to each cell of the partition 26 by moving the inspection objects A along the grooves until they fall from its one end into the respective cells.

The cameras 41 and 42 constitute a camera unit for photographing the inspection objects A from above and below the transparent member 16. The camera 41 is provided above the transparent member 16, and the camera 42 is provided below the transparent member 16.

The control unit 50 analyzes images obtained by photographing with the cameras 41, 42, and thereby detects foreign substances or defective goods mingling in the inspection objects A. Moreover, based on the results of such detection, the control unit 50 gives instructions to the suction controller 60 so that it may separate the foreign substances or defective goods from conforming goods by selectively sucking up the inspection objects A which are each put in the respective cells of the partition 26.

The suction controller 60 controls the suction operation of the suction nozzles 61 to 64 according to the instructions given by the control unit 50. The suction nozzles 61 to 64 remove the foreign substances or defective goods by sucking them up out of the inspection objects A put in the cells of the partition 26 on the transparent member 16. The collection box 69 for conforming goods recovers the conforming goods of the inspection objects A which have fallen as the partition 26 turns. That is, the suction controller 60, the suction nozzles 61 to 64, and the collection box 69 for collecting conforming goods constitute a separation means for achieving separation between conforming goods and foreign substances or defective goods.

In Embodiment 5, the hollow cylindrical partition 26 does rotational transfer on the longitudinally curved surface of the board-shaped transparent member 16, which is fixed at a position. During the process of such rotational transfer movement, the inspection objects A are each fed by the supplying unit 30 to each cell of the partition 26 on the transparent member 16. Under the conditions where the inspection objects A are each put in each cell of the partition 26, the inspection objects A are photographed by the cameras 41 and 42 from above and below the transparent member 16, respectively.

The control unit 50 analyzes images obtained by such photographing, and thereby detects foreign substances or defective goods mingling in the inspection objects A. Moreover, based on the results of such detection, the control unit 50 gives instructions to the suction controller 60. Then, out of the inspection objects A which are each put in each cell of the partition 26 on the transparent member 16, the foreign substances or defective goods are selectively sucked up by the suction nozzles 61 to 64 according to the instructions from the control unit 50, and thereby the foreign substances or defective goods are removed. Also, as the partition 26 moves, the conforming goods of the inspection objects A which are each put in each cell of the partition 26 fall to be recovered by the collection box 69 for collecting conforming goods.

As described above, in Embodiment 5, the inspection objects A are photographed under the conditions where the inspection objects A are each put in each cell of the partition 26, and then the suction removal of the foreign substances or defective goods, as well as the recovery of the conforming goods, is performed, whereby the inspection and selection of the inspection objects A are done easily even if the inspection objects A have a shape that tends to allow rolling.

Embodiment 6

Figure 6:
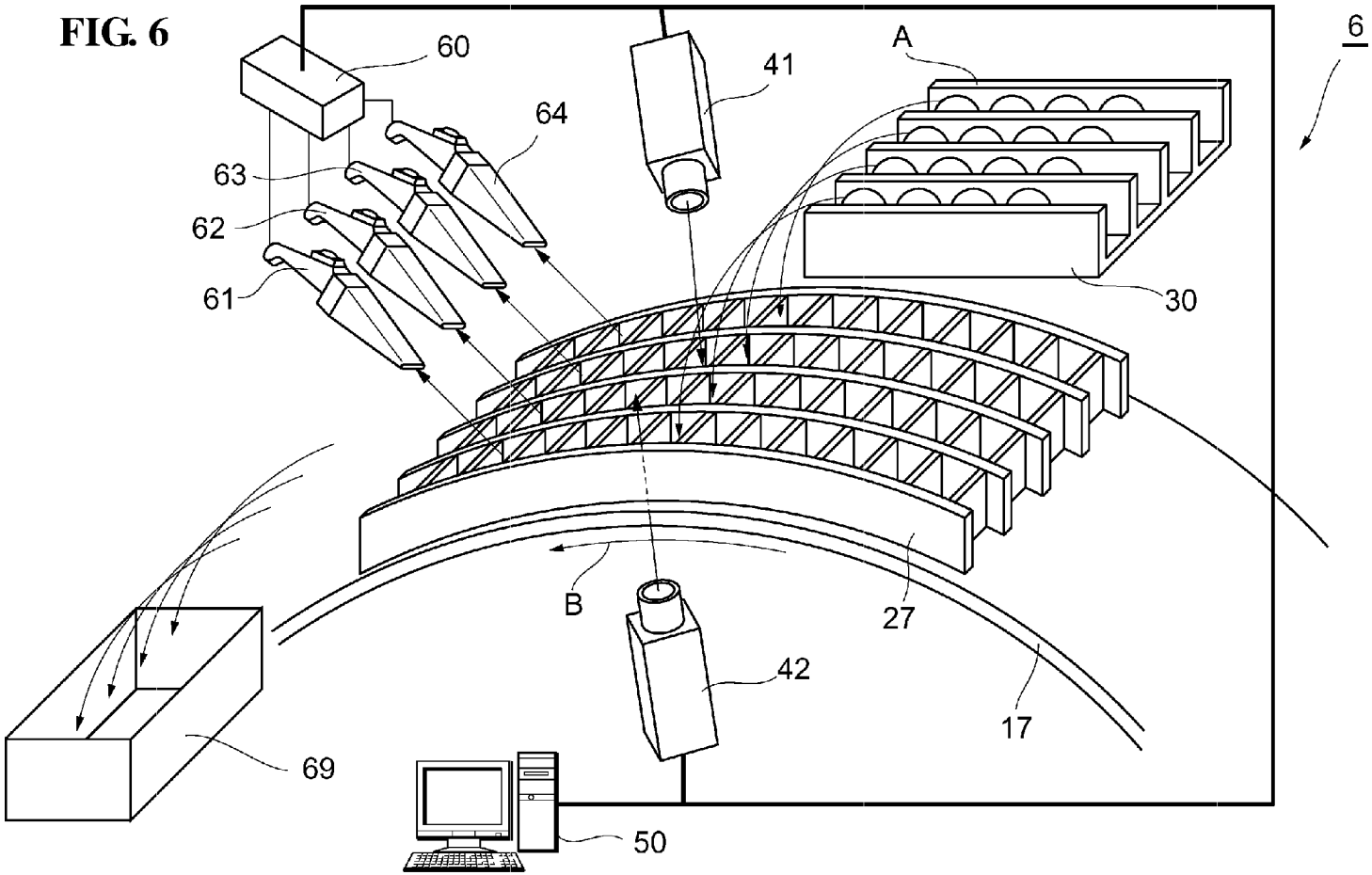
FIG. 6 is a conceptional schematic diagram showing a detection apparatus for detecting foreign substances or defective goods and a removing apparatus for removing the foreign substances or defective goods, according to Embodiment 6 of the present invention.

FIG. 6 is a conceptional schematic diagram showing the detection apparatus and the removing apparatus according to Embodiment 6 of the present invention. The detection apparatus included in the removing apparatus 6 detects, on the basis of images obtained by photographing inspection objects A, foreign substances or defective goods mingling in inspection objects A, and on the basis of the results of such detection, the removing apparatus 6 separates the inspection objects A in terms of conforming goods and foreign substances or defective goods. The detection apparatus relating to Embodiment 6 comprises a transparent member 17, a partition 27, a supplying unit 30, cameras 41 and 42, and a control unit 50. The removing apparatus 6 comprises, in addition to the detection apparatus, a suction controller 60, suction nozzles 61 to 64, and a collection box 69 for collecting conforming goods.

The transparent member 17 is fixed at a position, has a hollow cylindrical form, and consists of a material transparent to a wavelength to which the cameras 41 and 42 are sensitive. The partition 27 function to separate the inspection objects A on the transparent member 17 so that each piece of the inspection objects A may lie in each cell of the partition 27. The transparent member 17 is not united with the partition 27. The partition 27 has a hollow cylindrical form so as to move on the transparent member 17. (The partition 27 is provided on the whole circumference of the cylindrical transparent member 17; however, only a part thereof is shown in FIG. 6.) Preferably, spaces are provided between the partition 27 and the transparent member 17.

The partition 27 turns along arrow B as shown in FIG. 6. That is, the detection apparatus relating to Embodiment 6 is equipped with a transport means for moving the partition 27. A plurality of cells in the partition 27 are arranged two-dimensionally in the direction of movement and in the direction orthogonal to the direction of movement.

The supplying unit 30 has the same number of grooves as the number of cell lines (the number of cells arranged in the direction orthogonal to the direction of the movement) in the partition 27. The supplying unit 30 feeds each piece of inspection objects A to each cell of the partition 27 on the transparent member 17 by moving the inspection objects A along the grooves until each of the inspection objects A falls from its end into each cell.

The cameras 41 and 42 constitute a camera unit for photographing the inspection objects A from above and below the transparent member 17. The camera 41 is provided above the transparent member 17, and the camera 42 is provided below the transparent member 17.

The control unit 50 analyzes images obtained by photographing with the cameras 41, 42, and thereby detects foreign substances or defective goods mingling in the inspection objects A. Moreover, based on the results of such detection, the control unit 50 gives instructions to the suction controller 60 so that it may separate the foreign substances or defective goods from conforming goods by selectively sucking up the inspection objects A put in the cells of the partition 27.

The suction controller 60 controls the suction operation of the suction nozzles 61 to 64 according to the instructions given by the control unit 50. The suction nozzles 61 to 64 remove the foreign substances or defective goods by sucking them out of the inspection objects A put in the cells of the partition 27 on the transparent member 17. The collection box 69 for collecting conforming goods recovers the conforming goods that fall as the partition 27 turns. That is, the suction controller 60, the suction nozzles 61 to 64, and the collection box 69 for collecting conforming goods constitute a separation means for achieving separation between conforming goods and foreign substances or defective goods.

In Embodiment 6, the hollow cylindrical partition 27 rotationally moves on the fixed hollow cylindrical transparent member 17. During the process of such rotational transfer movement, the inspection objects A are each fed by the supplying unit 30 to each cell of the partition 27 on the transparent member 17. Under the conditions where the inspection objects A are each put in each cell of the partition 27, the inspection objects A are photographed by the cameras 41 and 42 from above and below the transparent member 17, respectively.

The control unit 50 analyzes images obtained by such photographing, and thereby detects foreign substances or defective goods mingling in the inspection objects A. Moreover, based on the results of such detection, the control unit 50 gives instructions to the suction controller 60. Then, out of the inspection objects A which are each put in each cell of the partition 27 on the transparent member 17, the foreign substances or defective goods are selectively sucked up by the suction nozzles 61 to 64 according to the instructions from the control unit 50, and thereby the foreign substances or defective goods are removed. Also, as the partition 27 moves, the conforming goods of the inspection objects A which are each put in each cell of the partition 27 fall to be recovered by the collection box 69 for collecting conforming goods.

As described above, in Embodiment 6, the inspection objects A are photographed under the conditions where the inspection objects A are each put in each cell of the partition 27, and then the suction removal of the foreign substances or defective goods, as well as the recovery of the conforming goods, is performed, whereby the inspection and selection of the inspection objects A are done easily even if the inspection objects A have a shape that tends to allow rolling.

Example of Modification

While this invention has been described in connection with what is presently considered to be the most practical and preferred embodiments, the invention is not limited to the disclosed embodiments, but on the contrary, is intended to cover various modifications and equivalent arrangements included within the spirit and scope of the appended claims. For example, Embodiments 1 to 6 may be modified to have the following compositions.

The transparent member may have a disc-like shape and may be united with the partition. The transparent member may have a disc-like shape or a part thereof (arc form), and it may not necessarily be united with the partition. While the disc-shaped transparent member turns, the following actions are performed in the enumerated order: the inspection objects are each supplied to each cell of the partition; the inspection objects put in each cell are photographed; the foreign substances or defective goods are detected by the analysis of the images obtained by such photographing; and the conforming goods and the foreign substances or defective goods are separated.

Each cell of the partition may have a lid that can open or close according to the control of the control unit. In such case, the cells of the partition may be designed such that the lid of a cell containing foreign substances or defective goods is open while the lid of a cell containing conforming goods is closed, or vice versa. The separation of inspection objects in terms of conforming goods and foreign substances or defective goods can be made as follows: the inspection objects contained in the cells whose lids are open are removed, and thereafter the inspection objects contained in the cells that have been closed are removed upon opening of the lids thereof. The operation to remove inspection objects each contained in each cell of the partition may be done in a manner where at least conforming goods, or foreign substances or defective goods, are subjected to a suction or dropping operation.

What is claimed is:

1. A detection apparatus for detecting foreign substances or defective goods mingling in inspection objects according to images obtained by photographing the inspection objects, wherein the detection apparatus comprises:

a transparent member for inspection objects to be put thereon;

a partition defining a plurality of cells for separating the inspection objects on the transparent member so that each cell defined by the partition is adapted to contain only one piece of the inspection objects;

a supplying unit for putting each piece of the inspection objects into each cell of the partition;

a camera unit for photographing the inspection objects from above and below the transparent member;

a control unit for detecting foreign substances or defective goods mingling in the inspection objects by analyzing images photographed with the camera unit; and a transport means for moving the partition, wherein plural separated columns of the partition are provided, and the partition is united with the transparent member column by column, and the adjacent columns are mutually connected in a caterpillar-like manner.

2. The detection apparatus according to claim 1, wherein a lid that can open or close according to the control of the control unit is provided for each cell of the partition.

3. A removing apparatus comprising: a detection apparatus according to claim 1; and a separation means for separating foreign substances or defective goods from conforming goods, wherein the separation of inspection objects each contained in the respective cells of the partition is done by selective suction operation of the separation means according to instructions given on the basis of detection results of the control unit.

4. A removing apparatus according to claim 3, wherein spaces are provided between the transparent member and the partition.

5. A removing apparatus according to claim 3, wherein the separation of conforming goods from foreign substances or defective goods for inspection objects each contained in a cell of the partition is done by the separation means sucking foreign substances or defective goods while conforming goods are dropped by up-and-down reverse transfer of the transparent member, or vice versa.

6. A detection apparatus for detecting foreign substances or defective goods mingling in inspection objects according to images obtained by photographing the inspection objects, wherein the detection apparatus comprises:

a transparent member for inspection objects to be put thereon;

a partition defining a plurality of cells for separating the inspection objects on the transparent member so that each cell defined by the partition is adapted to contain only one piece of the inspection objects;

a supplying unit for putting each piece of the inspection objects into each cell of the partition;

a camera unit for photographing the inspection objects from above and below the transparent member;

a control unit for detecting foreign substances or defective goods mingling in the inspection objects by analyzing images photographed with the camera unit; and a transport means for moving the partition, wherein the transparent member has a board-like shape and is fixed at a position, and the partition is structured to move on the transparent member in a belt conveyor-like manner.

7. The detection apparatus according to claim 6, wherein a lid that can open or close according to the control of the control unit is provided for each cell of the partition.

8. A removing apparatus comprising:

a detection apparatus according to claim 6; and a separation means for separating foreign substances or defective goods from conforming goods, wherein the separation of inspection objects each contained in the respective cells of the partition is done by selective suction operation of the separation means according to instructions given on the basis of detection results of the control unit.

9. The removing apparatus according to claim 8, wherein spaces are provided between the transparent member and the partition.

10. A detection method for detecting, on the basis of images obtained by photographing inspection objects, foreign substances or defective goods mingling in the inspection objects, comprising:

supplying each of the inspection objects to each cell of a partition while moving the partition on a transparent member, wherein each cell of the partition is adapted to receive only one piece of the inspection objects;

photographing the inspection objects from above and below the transparent member; and analyzing images obtained by such photographing of the camera unit, and thereby detecting foreign substances or defective goods mingling in the inspection objects, wherein plural separated columns of the partition are provided, and the partition is united with the transparent member column by column, and the adjacent columns are mutually connected in a caterpillar-like manner.

11. A removing method comprising:

detecting foreign substances or defective goods mingling in inspection objects, using the detection method according to claim 10; and separating the foreign substances or defective goods from conforming goods by selectively sucking the inspection objects each contained in each cell of the partition.

12. The removing method according to claim 11, wherein the separation of conforming goods from foreign substances or defective goods for inspection objects each contained in a cell of the partition is done by sucking foreign substances or defective goods while dropping conforming goods by up-and-down reverse transfer of the transparent member, or vice versa.

13. The removing method according to claim 11, wherein each cell of the partition each containing an inspection object has a lid capable of opening or closing according to the control of the control unit, and the lid of such cell containing a foreign substance or defective goods is closed while the lid of such cell containing conforming goods is open, or vice versa, so that the inspection object contained in an open cell is removed, and subsequently the inspection object contained in a closed cell is removed upon opening the lid thereof.

14. The removing method according to claim 13, wherein at least conforming goods, or foreign substances or defective goods are removed by a selective suction operation for inspection objects each contained in each cell of the partition.

15. The removing method according to claim 13, wherein at least conforming goods, or foreign substances or defective goods are removed by a selective dropping operation for inspection objects each contained in each cell of the partition.

16. A detection method for detecting, on the basis of images obtained by photographing inspection objects, foreign substances or defective goods mingling in the inspection objects, comprising:

supplying each of the inspection objects to each cell of a partition while moving the partition on a transparent member, wherein each cell of the partition is adapted to receive only one piece of the inspection objects;

photographing the inspection objects from above and below the transparent member; and analyzing images obtained by such photographing, and thereby detecting foreign substances or defective goods mingling in the inspection objects, wherein the transparent member has a board-like shape and is fixed at a position, and the partition is structured to move on the transparent member in a belt conveyor-like manner.

17. A removing method comprising:

detecting foreign substances or defective goods mingling in inspection objects, using the detection method according to claim 16; and separating the foreign substances or defective goods from conforming goods by selectively sucking the inspection objects each contained in each cell of the partition.

18. The removing method according to claim 17, wherein each cell of the partition each containing an inspection object has a lid capable of opening or closing according to the control of the control unit, and the lid of such cell containing a foreign substance or defective goods is closed while the lid of such cell containing conforming goods is open, or vice versa, so that the inspection object contained in an open cell is removed, and subsequently the inspection object contained in a closed cell is removed upon opening the lid thereof.

19. The removing method according to claim 18, wherein at least conforming goods, or foreign substances or defective goods are removed by a selective suction operation for inspection objects each contained in each cell of the partition.

20. The removing method according to claim 18, wherein at least conforming goods, or foreign substances or defective goods are removed by a selective dropping operation for inspection objects each contained in each cell of the partition.

* * * * *